US008318251B2

(12) United States Patent
Cavanaugh et al.

(10) Patent No.: US 8,318,251 B2
(45) Date of Patent: Nov. 27, 2012

(54) METHOD FOR COATING HONEYCOMB SEAL USING A SLURRY CONTAINING ALUMINUM

(75) Inventors: Dennis William Cavanaugh, Simpsonville, SC (US); Vinod P. Pareek, Albany, NY (US); Nuo Sheng, Schenectady, NY (US); Surinder Pabla, Greer, SC (US); Daniel J. Dorriety, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 370 days.

(21) Appl. No.: 12/570,696

(22) Filed: Sep. 30, 2009

(65) Prior Publication Data

US 2011/0074113 A1 Mar. 31, 2011

(51) Int. Cl.
*C23C 16/06* (2006.01)
*B05D 3/02* (2006.01)

(52) U.S. Cl. ..... 427/250; 427/255.34; 427/255.39

(58) Field of Classification Search ..... 427/250, 427/255.34, 255.39
See application file for complete search history.

(56) References Cited

U.S. PATENT DOCUMENTS

| | | | | |
|---|---|---|---|---|
| 4,869,421 | A * | 9/1989 | Norris et al. | 228/181 |
| 5,118,026 | A * | 6/1992 | Stacher | 228/157 |
| 5,366,765 | A | 11/1994 | Milaniak et al. | |
| 6,022,632 | A | 2/2000 | Olson et al. | |
| 6,110,262 | A * | 8/2000 | Kircher et al. | 106/14.44 |
| 6,334,907 | B1 * | 1/2002 | Das et al. | 148/280 |
| 6,444,054 | B1 | 9/2002 | Kircher et al. | |
| 6,610,416 | B2 | 8/2003 | Wallace et al. | |
| 6,758,388 | B1 * | 7/2004 | Leholm et al. | 228/181 |
| 2002/0158417 | A1 * | 10/2002 | Wallace et al. | 277/414 |
| 2004/0115355 | A1 * | 6/2004 | Bauer et al. | 427/376.1 |
| 2005/0031877 | A1 | 2/2005 | Gigliotti | |
| 2009/0126833 | A1 * | 5/2009 | Cavanaugh et al. | 148/248 |
| 2011/0101619 | A1 * | 5/2011 | Fairbourn et al. | 277/414 |

FOREIGN PATENT DOCUMENTS

EP 2174740 A1 * 4/2010

OTHER PUBLICATIONS

Aguero, A., et al., "Cyclic oxidation and mechanical behavior of slurry aluminide coatings for steam turbine components". Surface and Coatings Technology 201 (2007) 6253-6260.*

Rasmussen, Anders Juul, et al., "Microstructures of thin and thick slurry aluminide coatings on Inconel 690". Surface and Coatings Technology 202 (2008) 1479-1485.*

Hetmanczyk, M., et al., "Advanced materials and protective coatings in aero-engines applications". Journal of Achievement in Materials and Manufacturing Engineering. vol. 24 Issue 1 Sep. 2007, pp. 372-381.*

* cited by examiner

*Primary Examiner* — Bret Chen
(74) *Attorney, Agent, or Firm* — Dority & Manning, P.A.

(57) ABSTRACT

A method and composition are provided for coating honeycomb seals and, more specifically, to a method and slurry for applying an aluminide coating onto honeycomb seals. The method includes preparing a slurry of a powder containing a metallic aluminum alloy having a melting temperature higher than aluminum, an activator capable of forming a reactive halide vapor with the metallic aluminum, and a binder containing an organic polymer. The slurry is applied to surfaces of the honeycomb seal, which is then heated to remove or burn off the binder, vaporize and react the activator with the metallic aluminum to form the halide vapor, react the halide vapor at the substrate surfaces to deposit aluminum on the surfaces of the seal, and diffuse the deposited aluminum into the surfaces to form a diffusion aluminide coating.

19 Claims, 1 Drawing Sheet

METHOD FOR COATING HONEYCOMB SEAL USING A SLURRY CONTAINING ALUMINUM

FIELD OF THE INVENTION

The present invention relates to a method and composition for coating honeycomb seals as used e.g., in a turbine and, more specifically, to a method and slurry for applying an aluminide coating onto honeycomb seals.

BACKGROUND OF THE INVENTION

Honeycomb seals are used in multiple locations in gas turbines including certain stages of 7E gas turbines. For example, such seals may be used against the rails on shrouded buckets as an abradable material. The temperatures encountered at these locations can be relatively high. In a stage 2 location, temperatures at the seals can reach e.g., 870° C. or more. Unfortunately, even a honeycomb material made from an oxidation resistant alloy can experience oxidation and a shortening of useful life under these conditions.

Advances in high temperature capabilities have been achieved through the development of iron, nickel and cobalt-based superalloys and the use of oxidation-resistant environmental coatings capable of protecting superalloys from oxidation, hot corrosion, etc. For example, Haynes® 214® (provided by Haynes International of Kokomo, Ind.) is an oxidation-resistant alloy constructed from 75 Ni, 16 Cr, 4.5 Al, 3 Fe, 0.05 C, 0.01 Y, 0.5 Mn, 0.2 Si, 0.1 Zr, and 0.01 B (by weight percent). However, even when constructed from this material, the expected life of a honeycomb seal in stage 2 shrouds can be less than 20,000 hours.

Aluminum-containing coatings, particularly diffusion aluminide coatings, have found widespread use as environmental coatings on gas turbine engine components. During high temperature exposure in air, aluminum-containing coatings form a protective aluminum oxide (alumina) scale or layer that inhibits corrosion and oxidation of the coating and the underlying substrate. Diffusion coatings can be generally characterized as having an additive layer that primarily overlies the original surface of the coated substrate and a diffusion zone below the original surface. The additive layer of a diffusion aluminide coating contains the environmentally-resistant intermetallic phase MAI, where M is iron, nickel or cobalt, depending on the substrate material (mainly β(NiAl) if the substrate is Ni-base). The diffusion zone comprises various intermetallic and metastable phases that form during the coating reaction as a result of diffusional gradients and changes in elemental solubility in the local region of the substrate.

Diffusion aluminide coatings are generally formed by depositing and diffusing aluminum into the surface of a component at temperatures at or above about 760° C. Notable processes include pack cementation and vapor phase aluminizing (VPA) techniques, and diffusing aluminum deposited by chemical vapor deposition (CVD), slurry coating, or another deposition process. Pack cementation and VPA processes generally involve the use of an activator to transport aluminum from an aluminum source to the surface of the component being coated. For example, a halide activator (typically ammonium halide or an alkali metal halide) can be reacted with an aluminum-containing source (donor) material to form an aluminum halide gas (such as aluminum fluoride ($AlF_3$) or aluminum chloride ($AlCl_3$)) that travels to the surface of the component, where it reacts to reform and deposit aluminum. In contrast, aluminum deposited by slurry coating is typically diffused without an activator, relying instead on melting and subsequent diffusion of the deposited aluminum.

The processing temperature and whether an activator is used will influence whether a diffusion coating is categorized as an outward-type or inward-type. Outward-type coatings are formed as a result of using higher temperatures (e.g., at or near the solution temperature of the alloy being coated) and lower amounts of activator as compared to inward-type coatings. In the case of a nickel-based substrate, such conditions promote the outward diffusion of nickel from the substrate into the deposited aluminum layer to form the additive layer, and also reduce the inward diffusion of aluminum from the deposited aluminum layer into the substrate, resulting in a relatively thick additive layer above the original surface of the substrate. Conversely, lower processing temperatures and larger amounts of activator reduce the outward diffusion of nickel from the substrate into the deposited aluminum layer and promote the inward diffusion of aluminum from the deposited aluminum layer into the substrate, yielding an inward-type diffusion coating characterized by an additive layer that extends below the original surface of the substrate.

The choice of donor material influences whether an outward or inward-type diffusion coating can be produced since aluminum alloys such as CrAl, CoAl, FeAl, TiAl, etc., have higher melting temperatures than unalloyed aluminum and, therefore, can be used with the higher processing temperatures used to form outward-type coatings. Though both outward and inward-type diffusion aluminide coatings are successfully used, outward-type diffusion aluminide coatings typically have a more ductile and stable nickel aluminide intermetallic phase and exhibit better oxidation and low cycle fatigue (LCF) properties as compared to inward-type diffusion aluminide coatings.

Pack cementation and VPA processes are widely used to form aluminide coatings because of their ability to form coatings of uniform thickness. In pack cementation processes, the aluminum halide gas is produced by heating a powder mixture comprising the source material, the activator, and an inert filler such as calcined alumina. The ingredients of the powder mixture are mixed and then packed and pressed around the component to be treated, after which the component and powder mixture are heated to a temperature sufficient to vaporize the activator. The vaporized activator reacts with the source material to form the volatile aluminum halide, which then reacts at the component surface to form a aluminide coating, typically a brittle inward-type coating with high aluminum content due to the use of a relatively low treatment temperature to minimize sintering of the pack material and high activity required of the activator to offset the dilution effect of the inert filler. In contrast, VPA processes are carried out with the source material placed out of contact with the surface to be aluminized. Depending on the processing temperature and amount of activator used, VPA coatings can be inward or outward-type. A difficulty encountered with VPA processes is the inability to produce a uniform aluminide coating on all internal passages of a component.

Slurries used to form diffusion aluminide coatings are typically aluminum rich, containing only an unalloyed aluminum powder in an inorganic binder. The slurry is directly applied to surfaces to be aluminized, and aluminizing occurs as a result of heating the component in a non-oxidizing atmosphere or vacuum to a temperature above about 760° C., which is maintained for a duration sufficient to melt the aluminum powder and diffuse the molten aluminum into the surface. The thickness of a diffusion aluminide coating produced by a slurry method is typically proportional to the amount of the slurry applied to the surface, and as such, the amount of slurry applied must be very carefully controlled.

The difficulty of consistently producing diffusion aluminide coatings of uniform thickness has discouraged the use of slurry processes on components that require a very uniform diffusion coating and/or have complicated geometries. As a result, though capable of forming diffusion aluminide coatings on internal and external surfaces, slurry coating processes have been typically employed to coat limited, noncritical regions of gas turbine engines. Another limitation of slurry coating processes is that, because of the use of unalloyed aluminum, they are typically performed at relatively low temperatures (e.g., below 980° C.), and are therefore limited to producing an inward-type coating with high aluminum content.

Accordingly, a method and composition for applying an oxidation-resistant coating to honeycomb seals would be useful. Such a method and composition capable of depositing diffusion aluminide coatings of uniform thickness without labor-intensive cleaning to remove coating residues would be useful. A method and composition that may be used to over a wide range of temperatures that is capable of forming both inward and outward-type diffusion aluminide coatings would also be useful.

SUMMARY OF THE INVENTION

Aspects and advantages of the invention will be set forth in part in the following description, or may be obvious from the description, or may be learned through practice of the invention.

In one exemplary aspect, the present invention provides a method for creating a diffusion aluminide coating onto the surfaces of a honeycomb seal. The method includes preparing a slurry comprising a powder containing a metallic aluminum alloy having a melting temperature higher than aluminum, an activator capable of forming a reactive halide vapor with aluminum in the aluminum alloy, and a binder containing at least one organic polymer. The slurry is applied onto the surfaces of the honeycomb seal. The honeycomb seal is heated to remove or burn off the binder, vaporize and react the activator with the metallic aluminum to form the halide vapor, react the halide vapor at the surfaces of the component to deposit aluminum on the surfaces, and diffuse the deposited aluminum into the surfaces of the component to form a diffusion aluminide coating. The binder burns off to form a readily removable ash residue.

In another exemplary aspect, the present invention provides a honeycomb seal for a gas turbine having a diffusion aluminide coating formed from a slurry. The slurry consists essentially of about 35 to about 65% by weight of a powder containing a metallic aluminum alloy having a melting temperature higher than aluminum; about 1 to about 25% by weight of an activator capable of forming a reactive halide vapor with aluminum in the aluminum alloy; and about 25 to about 60% by weight of an organic polymer binder.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
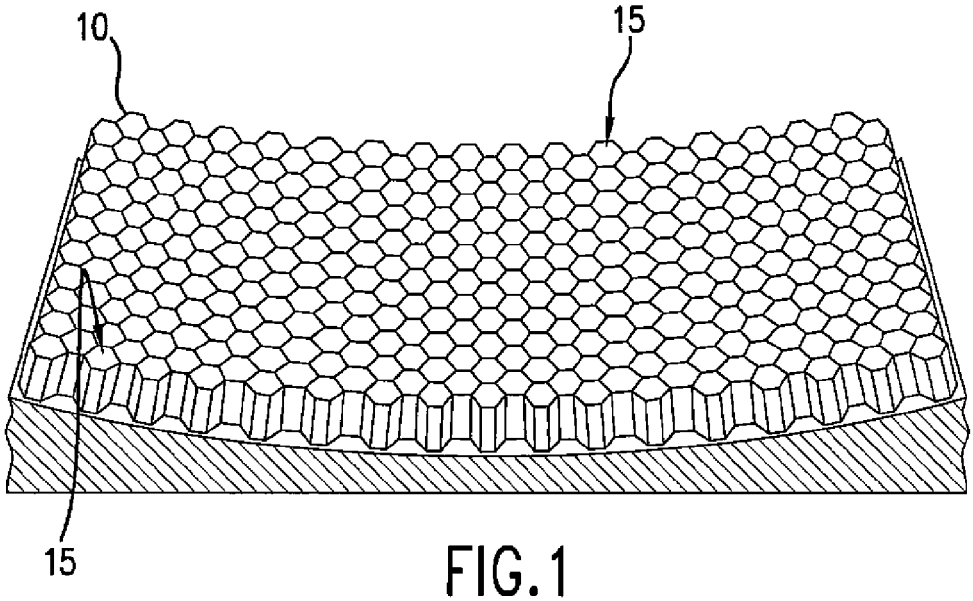
FIG. 1 is a perspective view of an exemplary portion of a honeycomb seal to which the method and composition of the present invention is applied.

The present invention relates to a method and composition for coating honeycomb seals and, more specifically, to a method and slurry for application of an aluminide coating onto honeycomb seals. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

FIG. 1 provides a perspective view of a honeycomb seal 10 as may be treated with the present invention. The seal includes individual, hexagonally-shaped cells 15. The example shown in FIG. 1 is a seal 10 as may be constructed of an oxidation resistant alloy comprising 75 Ni, 16 Cr, 4.5 Al, 3 Fe, 0.05 C, 0.01 Y, 0.5 Mn, 0.2 Si, 0.1 Zr, and 0.01 B (by weight percent) sold commercially as e.g., Haynes® 214®. The seal encounters conditions during operation of the gas turbine engine that can cause severe oxidation, corrosion and erosion.

Figure 2:
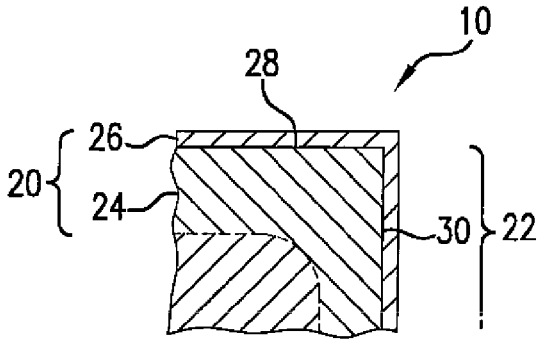
FIG. 2 is a partial sectional view of a portion of a honeycomb seal showing a diffusion aluminide coating on internal and external surfaces of the seal.

Seal 10 is protected from the hostile environment of the turbine section by the diffusion aluminide coating 20, shown in FIG. 2 as being formed on a substrate region 22 of the seal 10. The substrate region 22 may be the base superalloy of the seal 10, or an overlay coating such as MCrAlY deposited by known methods on the surface of the seal 10. When subjected to sufficiently high temperatures in an oxidizing atmosphere, the aluminide coating 20 develops an alumina ($Al_2O_3$) layer or scale (not shown) on its surface that inhibits oxidation of the diffusion coating 20 and the underlying substrate region 22. The diffusion aluminide coating 20 overlies all surfaces 28 and 30 of the individual cells 15 of seal 10.

Although not shown in FIG. 2, the surfaces of the seal 10 may be further protected by a thermal barrier coating (TBC) deposited on the aluminide coating 20. The TBC may be deposited by thermal spraying such as air plasma spraying (APS), low pressure plasma spraying (LPPS) and HVOF, or by a physical vapor deposition technique such as electron beam physical vapor deposition (EBPVD). Preferred TBC materials are zirconia partially stabilized with yttria (yttria-stabilized zirconia, or YSZ), though zirconia fully stabilized with yttria could be used, as well as zirconia stabilized by other oxides.

The aluminide coating 20 is represented in FIG. 2 as having two distinct zones, an outermost of which is an additive layer 26 that contains environmentally-resistant intermetallic phases such as MAI, where M is iron, nickel or cobalt, depending on the substrate material. The chemistry of the additive layer 26 may be modified by the addition of elements, such as chromium, silicon, platinum, rhodium, hafnium, yttrium and zirconium, for the purpose of modifying the environmental and physical properties of the coating 20. A typical thickness for the additive layer 26 is up to about 75 micrometers.

Beneath the additive layer 26 is a diffusion zone (DZ) 24 that typically extends about 25 to 50 micrometers into the substrate region 22. The diffusion zone 24 comprises various intermetallic and metastable phases that form during the coating reaction as a result of diffusional gradients and changes in elemental solubility in the local region of the substrate. These phases are distributed in a matrix of the substrate material.

The diffusion aluminide coating 20 is formed by a slurry process by which aluminum is deposited and diffused into the surfaces 28 and 30 to form aluminide intermetallics. The slurry process makes use of an aluminum-containing slurry, the composition of which includes a donor material containing metallic aluminum, a halide activator, and a binder containing an organic polymer. Notably missing from the ingredients of the slurry compositions are inert fillers and inorganic binders. In the absence of inert fillers, whose particles are prone to sintering, the coating process and slurry composition of this invention are well suited for use on the seal 10 of FIG. 1.

Suitable donor materials are aluminum alloys with higher melting temperatures than aluminum (melting point of about 660° C.). Particularly suitable donor metals include metallic aluminum alloyed with chromium, cobalt, iron, and/or another aluminum alloying agent with a sufficiently higher melting point so that the alloying agent does not deposit during the diffusion aluminiding process, but instead serves as an inert carrier for the aluminum of the donor material. Preferred donor materials are chromium-aluminum alloys.

An alloy that appears to be particularly well-suited for diffusion processes performed over the wide range of temperatures contemplated by this invention is believed to be 56Cr-44Al (about 44 weight percent aluminum, the balance chromium and incidental impurities). The donor material is in the form of a fine powder to reduce the likelihood that the donor material would become lodged or entrapped within the seal 10. For this reason, a preferred particle size for the donor material powder is −200 mesh (a maximum dimension of not larger than 74 micrometers), though it is foreseeable that powders with a mesh size of as large as 100 mesh (a maximum dimension of up to 149 micrometers) could be used.

Suitable halide activators include ammonium chloride ($NH_4Cl$), ammonium fluoride ($NH_4F$), and ammonium bromide ($NH_4Br$), though the use of other halide activators is also believed to be possible. Suitable activators must be capable of reacting with aluminum in the donor material to form a volatile aluminum halide (e.g., $AlCl_3$, $AlF_3$) that reacts at the surfaces 28 and 30 of the seal 10 to deposit aluminum, which is then diffused into the surfaces 28 and 30 to form the diffusion aluminide coating 20. A preferred activator for a given process will depend on what type of aluminide coating desired. For example, chloride activators promote a slower reaction to produce a thinner and/or outward-type coating, whereas fluoride activators promote a faster reaction capable of producing thicker and/or inward-type coatings. For use in the slurry, the activator is in a fine powder form. In some embodiments of the invention, the activator powder is preferably encapsulated to inhibit the absorption of moisture.

Suitable binders preferably consist essentially or entirely of alcohol-based or water-based organic polymers. A preferred aspect of the invention is that the binder is able to burn off entirely and cleanly at temperatures below that required to vaporize and react the halide activator, with the remaining residue being essentially in the form of an ash that can be easily removed, for example, by forcing a gas such as air over the surfaces 28 and 30 following the diffusion process. As used herein, "burn" or "burn off" means raising the temperature to a point where the binder is removed by evaporating or boiling off. The use of a water-based binder generally necessitates the above-noted encapsulation of the activator powder to prevent dissolution, while the use of an alcohol-based binder does not. Commercial examples of suitable water-based organic polymeric binders include a polymeric gel available under the name Vitta Braz-Binder Gel from the Vitta Corporation. Suitable alcohol-based binders can be low molecular weight polyalcohols (polyols), such as polyvinyl alcohol (PVA). The binder may also incorporate a cure catalyst or accelerant such as sodium hypophosphite. It is foreseeable that other alcohol or water-based organic polymeric binders could also be used.

Suitable slurry compositions for use with this invention have a solids loading (donor material and activator) of about 10 to about 80 weight percent, with the balance binder. More particularly, suitable slurry compositions of this invention contain, by weight, about 35 to about 65% donor material powder, about 25 to about 60% binder, and about 1 to about 25% activator. More preferred ranges are, by weight, about 35 to about 65% donor material powder, about 25 to about 50% binder, and about 5 to about 25% activator. Within these ranges, the slurry composition has consistencies that allow its application to the external and internal surfaces 28 and 30 of the seal 10 by a variety of methods, including spraying, dipping, brushing, injection, etc.

In one exemplary aspect of the invention, slurries can be applied to have a non-uniform green state (i.e., undried) thicknesses, yet produce diffusion aluminide coatings of very uniform thickness. For example, slurry coatings deposited to have thicknesses of about 0.010 inch (about 0.25 mm) to about 1 inch (about 25 mm) and greater have been shown to produce diffusion aluminide coatings whose thicknesses are very uniform, for example, varying by as little as about 0.0005 inch (about 0.01 mm) or less.

As a result, slurry compositions of this invention can be applied to the seal 10 by brushing onto seal 10 including application into the cells 15. Slurry compositions can also be applied by dipping the seal 10 into the slurry such as e.g., filling a trough or container with the slurry and placing the seal 10—face down—into the slurry so that the cells 15 are filled. By way of further example, slurry may be applied by pouring over the seal 10 to fill individual cells 15. The slurry could be applied to the seal 10 by spraying onto all cells. The slurry could also be applied by pumping the slurry into the cells 15 individually or all at one time. For some methods, the viscosity of the slurry may be decreased to facilitate application. Combinations of these and other techniques may be used to apply the slurry as well.

Another advantageous aspect of certain embodiments of the present invention is that the slurry coating composition is capable of producing diffusion aluminide coatings 20 over a broad range of diffusion treatment temperatures, generally in a range of about 815° C. to about 1150° C. Within this broad range, the diffusion temperature can be tailored to preferentially produce either an inward or outward-type coating, along with the different properties associated with these different types of coatings.

For example, the high temperature capability of the slurry composition of this invention enables the production of an outward-type diffusion aluminide coating which, as previously noted, is typically more ductile, has a more stable nickel aluminide intermetallic phase, and exhibits better oxidation and LCF properties as compared to inward-type diffusion aluminide coatings. It is believed the particular types and amounts of donor material and activator can also be used to influence whether an inward or outward-type coating is produced within the above-noted treatment temperature range.

After applying the slurry to the surfaces 28 and 30 of the seal 10, the seal 10 can be immediately placed in a coating chamber (retort) to perform the diffusion process. Additional coating or activator materials are not required to be present in the retort, other than what is present in the slurry. The retort is evacuated and preferably backfilled with an inert or reducing atmosphere (such as argon or hydrogen, respectively). The temperature within the retort is then raised to a temperature sufficient to burn off the binder, for example about 150° C. to about 200° C., with further heating being performed to attain the desired diffusion temperature as described above, during which time the activator is volatilized, the aluminum halide is formed, aluminum is deposited on the surfaces 28 and 30 of the seal 10. The seal 10 is held at the diffusion temperature for a duration of about one to about eight hours, again depending on the final thickness desired for the coating 20.

Following the coating process, the seal 10 is removed from the retort and cleaned of any residues from the coating process remaining in and on the seal 10. Such residues have been observed to be essentially limited to an ash-like residue of the binder and residue of donor material particles, the latter of which is primarily the metallic constituent (or constituents) of the donor material other than aluminum. In any case, the residues remaining following the coating process of this invention have been found to be readily removable, such as with forced gas flow, without resorting to more aggressive removal techniques such as wire brushing, glass bead or oxide grit burnishing, high pressure water jet, or other such methods that entail physical contact with a solid or liquid to remove firmly attached residues. Because of the ease with which the residues can be removed, the coating process of this invention is well suited for depositing coatings on surfaces (such as e.g., the surfaces of the seal 10 that are internal) that cannot be reached by the aforementioned aggressive surface treatments.

As part of investigations leading to the present invention, each cell of sample honeycomb seals were filled with slurry and the surfaces of the entire honeycomb seal were otherwise placed into contact with slurry. The seals were then placed onto racks in a retort under an argon atmosphere (hydrogen or any inert gas could also have been used). Trials were conducted at about 927° C., 1038° C., and 1093° C. for 2 hours to 12 hours to develop thickness data. For example, at 1093° C., coating thicknesses on the seals of about 1.6 mils, 2.25 mils, and 2.6 mils were achieved for 2, 4, and 12 hour trials respectively. After the furnace run was complete, the remnant slurry material was removed from the seal by blowing air with pressurized shop air.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A method for creating a diffusion aluminide coating onto the surfaces of a honeycomb seal, the steps comprising:

preparing a slurry comprising a powder containing a metallic aluminum alloy having a melting temperature higher than aluminum, an activator capable of forming a reactive halide vapor with aluminum in the aluminum alloy, and a binder containing at least one organic polymer;

applying the slurry onto the surfaces of the honeycomb seal;

heating the honeycomb seal to remove the binder, vaporize and react the activator with the metallic aluminum to form the halide vapor, react the halide vapor at the surfaces of the honeycomb seal to deposit aluminum on the surfaces, and diffuse the deposited aluminum into the surfaces of the honeycomb seal to form a diffusion aluminide coating, wherein the binder is removed to form a readily removable ash residue, wherein the temperature of said step of heating and the amount of activator used in said step of preparing are selected so that the diffusion aluminide coating is an outward-type.

2. A method according to claim 1, wherein the powder contains a chromium-aluminum alloy.

3. A method according to claim 1, wherein the powder has a particle size of up to 100 mesh.

4. A method according to claim 1, wherein the activator is chosen from the group consisting of ammonium chloride, ammonium fluoride, and ammonium bromide.

5. A method according to claim 1, wherein the binder consists of the at least one organic polymer.

6. A method according to claim 1, wherein the slurry consists essentially of, by weight, about 35 to about 65% of the powder, about 1 to about 25% of the activator, and about 25 to about 60% of the binder.

7. A method according to claim 6, wherein the powder consists essentially of a chromium-aluminum alloy.

8. A method according to claim 6, wherein the powder has a particle size of up to 100 mesh.

9. A method according to claim 6, wherein the activator is chosen from the group consisting of ammonium chloride, ammonium fluoride, and ammonium bromide.

10. A method according to claim 6, wherein the binder consists of the at least one organic polymer.

11. A method according to claim 1, wherein the surfaces comprise at least one internal surface within the seal.

12. A method according to claim 1, wherein the surfaces comprise at least one external surface of the seal.

13. A method according to claim 1, wherein the surfaces comprise internal surfaces within the seal and external surfaces of the seal.

14. A method according to claim 1, wherein the applying step comprises depositing a non-uniform layer of the slurry on the surfaces.

15. A method according to claim 1, wherein the seal is heated to a temperature within a range of about 815° C. to about 1150° C.

16. A method according to claim 1, wherein said applying step comprises placing the honeycomb seal into the slurry by dipping.

17. A method according to claim 16, wherein the honeycomb seal is formed of a nickel-based alloy.

18. A method for creating a diffusion aluminide coating onto the surfaces of a honeycomb seal, the steps comprising:

preparing a slurry comprising a powder containing a metallic aluminum alloy having a melting temperature higher than aluminum, an activator capable of forming a reactive halide vapor with aluminum in the aluminum alloy, and a binder containing at least one organic polymer;

applying the slurry onto the surfaces of the honeycomb seal;

heating the honeycomb seal to remove the binder, vaporize and react the activator with the metallic aluminum to form the halide vapor, react the halide vapor at the surfaces of the honeycomb seal to deposit aluminum on the surfaces, and diffuse the deposited aluminum into the surfaces of the honeycomb seal to form a diffusion aluminide coating, wherein the binder is removed to form a readily removable ash residue, wherein the temperature of said step of heating and the amount of activator used in said step of preparing are selected so that the diffusion aluminide coating is an inward-type.

19. A method for creating a diffusion aluminide coating onto the surfaces of a honeycomb seal, the steps comprising:

preparing a slurry comprising a powder containing a metallic aluminum alloy having a melting temperature higher than aluminum, an activator capable of forming a reactive halide vapor with aluminum in the aluminum alloy, and a binder containing at least one organic polymer;

heating the honeycomb;

removing the binder;

vaporizing and reacting the activator with the metallic aluminum to form the halide vapor;

reacting the halide vapor at the surfaces of the honeycomb seal to deposit aluminum on the surfaces;

diffusing the deposited aluminum into the surfaces of the honeycomb seal to form a diffusion aluminide coating; and forming a readily removable ash residue from the binder;

wherein the temperature of said step of heating and the amount of activator used in said step of preparing are predetermined so at create either an inward-type or outward-type diffusion aluminide coating.

* * * * *